US007270038B1

(12) United States Patent
McGee

(10) Patent No.: US 7,270,038 B1
(45) Date of Patent: Sep. 18, 2007

(54) MAT FOR DIE CUTTER

(76) Inventor: Sean McGee, P.O. Box 1328, Fremont, NE (US) 68025

( * ) Notice: Subject to any disclaimer, the term of this patent is extended or adjusted under 35 U.S.C. 154(b) by 56 days.

(21) Appl. No.: 11/177,188

(22) Filed: Jul. 8, 2005

(51) Int. Cl.
*B26D 5/08* (2006.01)
*B26D 7/00* (2006.01)

(52) U.S. Cl. ..... 83/13; 83/566

(58) Field of Classification Search ..... 83/566–570, 83/531–533, 540; 101/3.1, 5–6, 22–23; 72/207, 72/192; 492/51–56
See application file for complete search history.

(56) References Cited

U.S. PATENT DOCUMENTS 4,960,019 A * 10/1990 Levene et al. ..... 83/19
5,078,535 A * 1/1992 Kirkpatrick ..... 403/339
5,104,370 A * 4/1992 Yerly et al. ..... 493/372
5,647,260 A 7/1997 Nabity
5,778,748 A * 7/1998 Beijen ..... 83/529
6,220,136 B1 * 4/2001 Benes et al. ..... 83/566
7,127,987 B2 * 10/2006 Criss ..... 101/28
2002/0152868 A1 * 10/2002 Benes et al. ..... 83/531

* cited by examiner

*Primary Examiner*—Kenneth E. Peterson
*Assistant Examiner*—Phong Nguyen

(57) ABSTRACT

A cutting mat includes a flat, planar sheet of rigid but flexible material with a plastic film affixed to the lower surface and extending across the length and width of the sheet. In the preferred embodiment, the mat is formed of spring steel. A holder for the mat is formed of a planar sheet of plastic material with flaps formed in the holder to removably retain the cutting mat in position on the holder.

3 Claims, 2 Drawing Sheets

MAT FOR DIE CUTTER

CROSS-REFERENCES TO RELATED APPLICATIONS (Not applicable)

STATEMENT AS TO RIGHTS TO INVENTIONS MADE UNDER FEDERALLY SPONSORED RESEARCH AND DEVELOPMENT (Not Applicable)

INCORPORATION-BY-REFERENCE OF MATERIAL Submitted on a Compact Disc (Not applicable)

BACKGROUND OF THE INVENTION (1) Field of the Invention

The present invention relates generally to portable die cutting apparatus, and more particularly to an improved cutting mat for die cutters.

(2) Description of Related Art including information disclosed under 37 CFR 1.97, 1.98

Die cutting apparatus have long been used for cutting shapes and patterns from continuous sheet stock material. Rotary die cutting machines are typically expensive pieces of equipment, and are also expensive to operate, and are therefore unsuitable for smaller tasks.

In order to fulfill a need by educational institutions and the home consumer, a variety of smaller, portable roller die cutting machines have been developed. One such machine is disclosed in U.S. Pat. No. 5,647,260 to Stephen Nabity. This smaller, more economical device provides the necessary tools for cutting small shapes and designs, which may be used by the home craft industry as well as educational institutions.

A relatively new design of portable roller cutting die apparatus is that shown in pending patent application Ser. No. 29/227,314 entitled "Portable Die Cutter" and owned by the same owner of the present application. This portable device includes a pair of rollers mounted in spaced-apart parallel relationship and interconnected by gears to rotate simultaneously in opposing directions. The rollers are operably mounted within a lightweight housing, such that the entire device is lifted and operated with one hand of a consumer. A pair of wheels on the housing are rotated by pushing the housing along the surface of a table or the like, thereby rotating the rollers. A die assembly is fed between the rollers in a conventional fashion in order to cut stock positioned in the die assembly.

While the portable die cutter described above works well, there are aspects that it is desirable to address in order to improve the overall operation and ease of use of the device. For example, it is typical for the consumer to run the die assembly through the device 2 or 3 times to insure a clean continuous cut of the stock material. While this is not difficult to accomplish, it is undesirable to find that the apparatus was not operated a sufficient number of times to produce a clean cut. The partially cut stock is typically discarded, and the process started again. This can become frustrating if it occurs more than once during a session.

In addition to the frustration of a partially cut item, the increased number of times that the device is operated also reduces the life of the cutting mats and dies used in the machine. Thus, the efficiency of the machine is reduced proportional to the extra number of times that the machine must be operated to complete a cut.

The die assembly of prior art portable die cutters typically includes a base platform with a solid smooth upper surface. A cutting die is positioned on top of the platform with the die cutting edges projecting upwardly. The desired stock is placed on top of the die, and then a cutting mat is positioned over the top of the stock. This entire assembly is then fed between the rollers of the die cutter, which squeezes the assembly to cause the die to cut through the stock, against the cutting mat. The blade of the die cuts slightly into the cutting mat—thereby protecting the roller from being cut. The typical cutting mat is a sheet of plastic material, which must be replaced frequently during the die-cutting process, since the mat is partially cut during each operation of the device.

While plastic cutting mats work sufficiently, it is preferable to provide cutting mats of a more lasting material, such as spring steel. However, a drawback to the use of spring steel is that the mat is quite thin, and the edges of the mat can injure the user if not handled carefully. Thus, it is desirable to provide a holder for the cutting mat, which protects the users fingers from the edges of the mat.

Another drawback to spring steel cutting mats is the fact that the spring steel is not as compressible as the plastic material of plastic cutting mats. Thus, while the steel mats last longer, they can require additional runs through the die cutter to complete a cut.

BRIEF SUMMARY OF THE INVENTION

It is therefore a general object of the present invention to provide an improved cutting mat for a portable die cutter.

A further object is to provide a metal cutting mat with a holder to protect the user's fingers from the edges of the mat.

Yet another object of the present invention is to provide a cutting mat with a compressible sheet of material to enhance the cutting operation of the die cutter.

These and other objects will be apparent to those skilled in the art.

The cutting mat of the present invention includes a flat, planar sheet of rigid but flexible material with a plastic film affixed to the lower surface and extending across the length and width of the sheet. In the preferred embodiment, the mat is formed of spring steel. A holder for the mat is provided, formed of a planar sheet of plastic material with flaps formed in the holder to removably retain the cutting mat in position on the holder.

BRIEF DESCRIPTION OF THE SEVERAL VIEWS OF THE DRAWING

The preferred embodiment of the invention is illustrated in the accompanying drawings, in which similar or corresponding parts are identified with the same reference numeral throughout the several views, and in which.

DETAILED DESCRIPTION OF THE INVENTION

Figure 1:
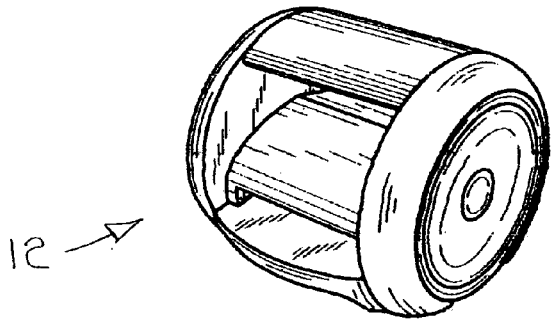
FIG. 1 is a perspective view of a portable die cutter in which the cutting mat of the present invention may be used.
Figure 2:
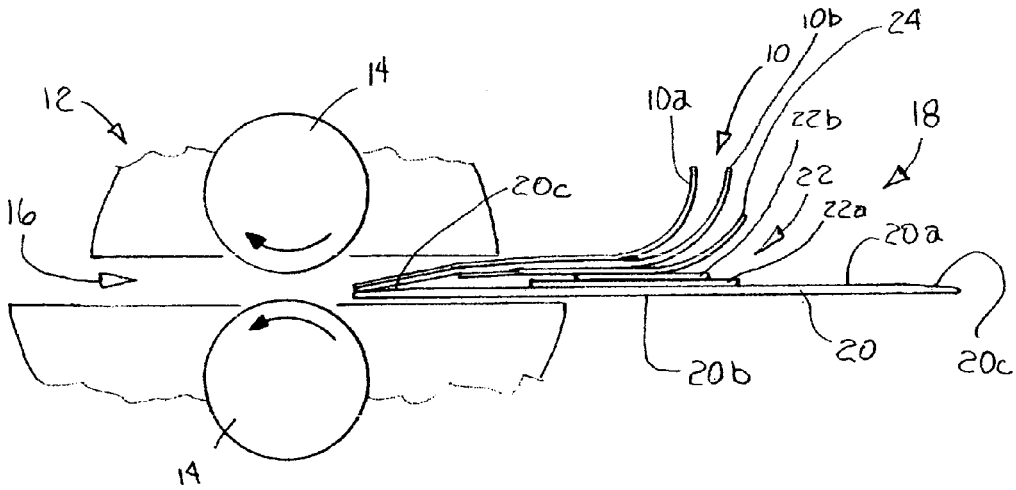
FIG. 2 is a schematic side view of a die assembly with the cutting mat of the present invention incorporated therein, and positioned in a roller die cutter of FIG. 1.

Referring now to the drawings, and more particularly to FIG. 1, a portable die cutter 12 is shown. While there are several varieties of portable die cutters available on the market, the cutting mat 10 of the present invention is designed specifically for use with a die cutter 12 of the type having opposing rotatable rollers 14, as shown in FIG. 2.

Die cutter 12 includes a horizontally disposed slot 16 formed therethrough, through which die assembly 18 is directed. Die assembly 18 is drawn between rollers 14 to squeeze the die assembly 18 and cause a die to cut a pattern in a piece of stock material, as described in more detail hereinbelow. Die assembly 18 includes an elongated, planar platform 20 of substantially rigid material, such as a high-density plastic. Platform 20 has a flat upper and lower surfaces 20*a* and 20*b*, respectively. However, the upper surface 20*a* is preferably tapered down to a smaller thickness 20*c* at each end of the platform. These tapered ends 20*c* assist in directing the assembly 18 between rollers 14 without disturbing the position of the die, stock and cutting mat of the die assembly 18.

It should be noted that the sheet of stock material 24 and the two layers of cutting mat 10 are shown with their rearward edges lifted and curled upwardly away from the die 22 and platform 20, in order to more clearly identify each of these components. In actual use, die assembly 18 would lay substantially flat, in a sandwich of layers.

A desired die 22 is positioned generally centrally on the top surface 20*a* of platform 20. Die 22 typically includes a flat metal base portion 22*a* with an upwardly projecting blade portion 22*b*. Blade portion 22*b* may be formed in any of a wide variety of shapes and sizes, to form cuts of desired characteristics in stock material 24. Blade portion 22*b* is also preferably metal.

Cutting mat 10 of the present invention is formed of two layers of material: a high-density planar sheet 10*a* with a with a plastic film 10*b* permanently mounted on a the lower cutting surface of the sheet 10*a*. Preferably, sheet 10*a* is a rectangular piece of 0.007-inch spring steel, such as 1095 tempered steel. The edges of sheet 10*a* should be burr free, to decrease the chance of injury to a user. Sheet 10*a* has a length and width greater than that of the die 22 as well as stock material 24, to form an upper backing plate in die assembly 18. Film 10*b* is about 0.002 inches in thickness, and has a permanent adhesive backing, so as to affix the film to the cutting surface of sheet 10*a* to form an integral unit.

It has been found that the addition of a layer of film 10*b* to the standard cutting mat 10*a* serves two beneficial purposes. First, the film adds a layer of thickness, which causes an increase of pressure when die assembly 18 is run between rollers 14 of die cutter 12. This is turn increases the cutting distance of the die 22, and increases the chances of a complete and clean cut with fewer runs through the rollers 14. When using film layer 10*b*, the cutter will create a clean complete cut in 1-3 runs through the die cutter, whereas without the film, it typically required additional runs, and sometimes a complete and clean cut simply would not occur.

The second benefit of the film layer 10*b* is the additional layer of protection for cutting mat sheet 10*a*. Thus, film 10*b* acts as a type of "wear plate" for mat 10*a*, thereby increasing the effective life of the cutting mat 10.

One undesirable characteristic of spring steel as a material for cutting mat 10 is the sharpness of the edges of the mat. While not typically a problem, the fact that the material has a very small thickness increases the opportunity of a cut or injury when handling the cutting mat 10. The inventor herein has devised a holder 26, which will safely retain cutting mat 10 in position, without requiring the user to touch the mat 10 after installation in the holder.26, as shown in FIGS. 3 and 4.

Figure 4:
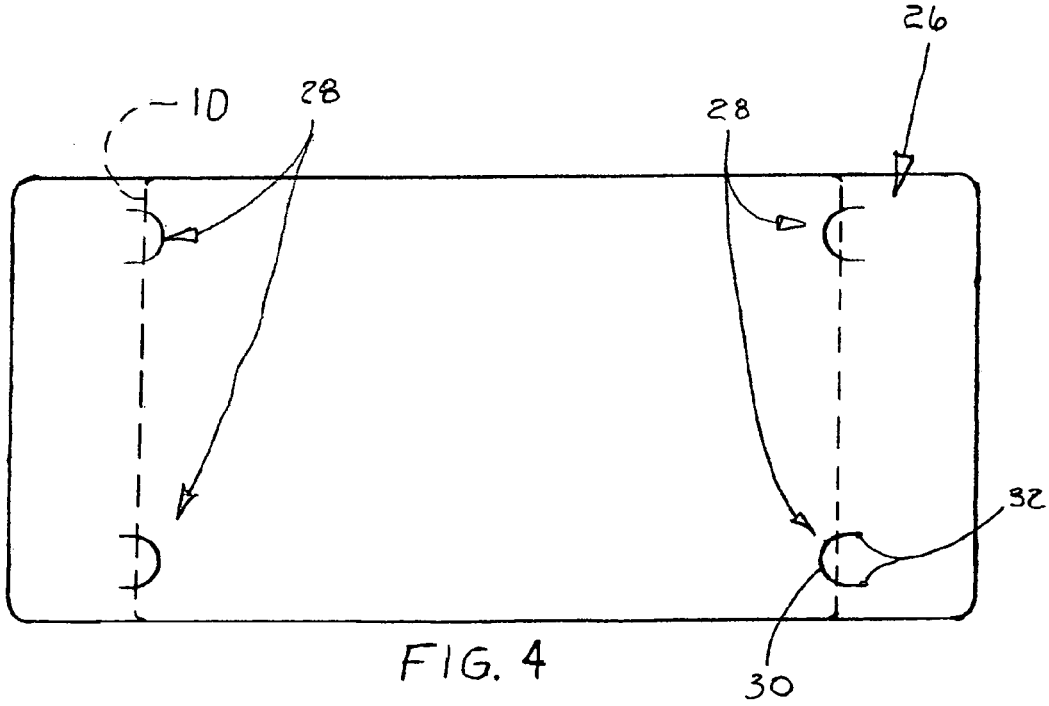
FIG. 4 is a plan view of the mat holder of FIG. 3.

Referring now to FIG. 4, holder 26 is shown with a cutting mat 10 in broken lines, to show the retained position of the mat 10. Holder 26 is preferably formed of a plastic material such as clear PETG or its equivalent with a thickness of about 0.015 inches. While there are a variety of ways in which holder 26 can retain mat 10 in position, it has been found that the use of four semi-circular flaps 28 is a simple and efficient manner of accomplishing this task. While other shapes would work, the semi-circular shape was chosen for its omission of sharp points.

Each flap 28 is formed by cutting a semi-circle 30 through the thickness of holder sheet 26, with the two termini 32 of each semi-circle directed towards the end edges of the holder sheet. Two flaps 28 are aligned both longitudinally and transversely on holder 26, and positioned apart a distance to retain cutting mat 10 therebetween.

Figure 3:
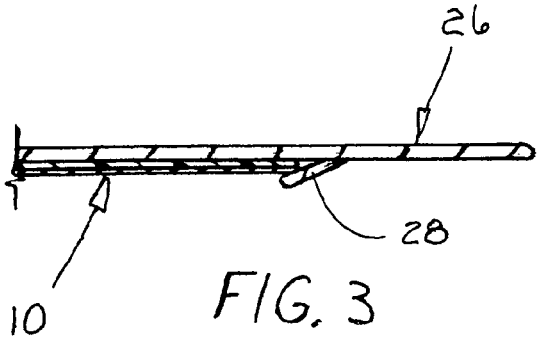
FIG. 3 is an enlarged sectional view of a portion of a mat holder with the cutting mat retained thereon.

FIG. 3 shows one flap 28 of holder 26 pushed downwardly to retain an edge of cutting mat 10 between the flap 28 and holder 26.

Whereas the invention has been shown and described in connection with the preferred embodiments thereof, many modifications, substitutions and additions may be made which are within the intended broad scope of the appended claims. For example, the lengths, widths and thicknesses of the described embodiments are simply given as examples of versions of the invention that work for a particular die cutter. Other thicknesses and dimensions would work with this die cutter, and other similar die cutters. Similarly, the listed materials could be different than those specified, and remain within the spirit and scope of the invention.

What is claimed is:

1. A method of die cutting a shape from paper stock, comprising the steps of:

forming a die assembly by:

positioning a die with an upwardly projecting blade on the top of a support platform;

positioning a sheet of stock material over the top of the die blade; and positioning a flat, planar cutting mat over the top of the stock material, the cutting mat having a plastic film affixed to and extending across the extent of the lower surface thereof, in contact with the stock material;

removably retaining the cutting mat in a holder with the plastic film of the cutting mat exposed, and wherein the step of positioning the cutting mat includes positioning the holder over the stock material such that the plastic film of the cutting mat is in flush contact with the stock material;

the step of removably retaining the cutting mat in a holder further including the steps of:

providing a planar sheet with a plurality of flaps formed therein to serve as a holder; and attaching the cutting mat to the holder by journaling at least two edges of the cutting mat under at least two flaps of the holder;

journaling the assembly between the rollers of a roller die cut machine;

moving the assembly between the rollers, such that the rollers squeeze the die assembly to force the die blade through the stock material and into the film of the cutting mat; and removing the assembly from the die cut machine and removing the cut shape from the die assembly.

2. The method of claim 1, wherein the step of forming a die assembly further includes the step of permanently attaching a plastic film to a flat planar sheet of generally rigid but flexible material, to form a cutting mat.

3. The method of claim 2, wherein the planar sheet is formed of spring steel.

* * * * *